United States Patent [19]

Dernis

[11] Patent Number: 4,694,545

[45] Date of Patent: Sep. 22, 1987

[54] ATTACHMENT OF RINGS WITHOUT SEWING

[76] Inventor: David Dernis, 13321 SW. 80th St., Miami, Fla. 33183

[21] Appl. No.: 807,449

[22] Filed: Dec. 10, 1985

[51] Int. Cl.[4] ..... B21D 37/04

[52] U.S. Cl. ..... 29/1 R; 29/433; 160/84 R

[58] Field of Search ..... 160/84 R; 29/433, 1 R

[56] References Cited

U.S. PATENT DOCUMENTS 3,734,809 5/1973 Ellis ..... 160/84 R

*Primary Examiner*—Timothy V. Eley

*Attorney, Agent, or Firm*—Joseph Zallen

[57] ABSTRACT

A ring can be attached to a sheet such as fabric, sailcloth or tent canvas without sewing by the use of the combination of a U-shaped, stiff filament and an open tube to which the ring is attached. The legs of the filament are passed through the sheet then through the tube to the other end where they are fixed by holding means.

2 Claims, 9 Drawing Figures

ATTACHMENT OF RINGS WITHOUT SEWING

BACKGROUND OF INVENTION

This invention relates to methods and devices for attaching loops or rings to sheet materials such as drapery fabric, sail cloth, or tent canvas without the necessity of sewing. In particular it relates to removable attachment of rings to Roman or balloon shades without the necessity of sewing.

Cords passing through the rings of Roman shades enable the shades to be raised and lowered. The rings are conventionally attached to the drapery fabric by sewing at the desired locations. Because of a very large number of rings that are needed for a Roman shade, the requirement for sewing the rings results in a high labor cost and fabrication time.

One object of this invention is to provide methods and devices for attaching rings to sheet materials without the necessity of sewing.

Other objects and advantages of the present invention will be apparent from the description and claims which follow, taken together with the appended drawings.

SUMMARY OF INVENTION

The invention comprises broadly the combination of a U-shaped stiff filament and an open tube to which a ring or loop is attached. It is applicable to a wide range of uses, such as the attachment without sewing of rings to drapery fabric, construction of rings for grommets without sewing in sails, tents and canvas covers, and removable rings for hanging towels and the like on hooks.

The legs of the filament are inserted through a sheet such as fabric, sailcloth or canvas, and then passed through the open tube where holding means are applied so as to firmly attach the filament to the tube. The tubular member of this invention thus comprises an integral closed loop or ring portion attached to the tube open at both ends. It is preferred that the holding means are removable, so that the filament and tubular member can be removed and/or repositioned.

The U-shaped filament can be applied manually or mechanically and initially can be straight or pre-formed into U-shape. Removal of the cap or sleeve allows the tubular member to be withdrawn from the legs of the filament and the filament withdrawn from the sheet. The insertion or withdrawal of the filament does very little damage, if any, to the sheet so that changing location is feasible even after the filament has been inserted. This is important since moving the location of rings is often necessary to make a proper installation or reinstallation. Applying this invention to drapery fabrics, rings can be located after mounting on a window without removing the drape from the window.

Suitable materials for this invention include plastic materials such as 6,6 nylon or polyethylene terephthalate prepared as extruded filaments or metal filaments. Typical diameters are in the range of approximately 0.20 to 0.25 inches. Tensile strength is preferably at least 40 pounds per square inch.

SPECIFIC EXAMPLE OF INVENTION

Figure 1:
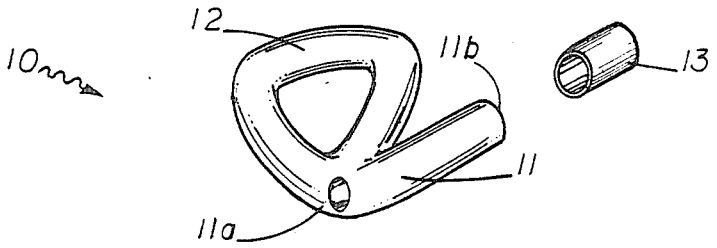
FIG. 1 is a three-quarter perspective view of a device made in accordance with this invention.
Figure 2:
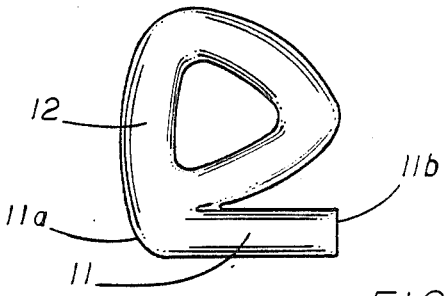
FIG. 2 is a side view.
Figure 3:
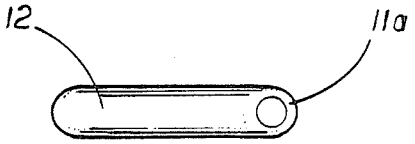
FIG. 3 is a first end view.
Figure 4:
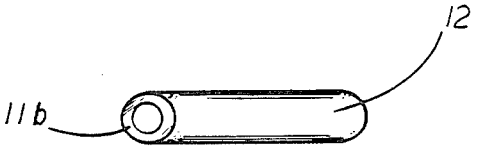
FIG. 4 is a second end view.
Figure 5:
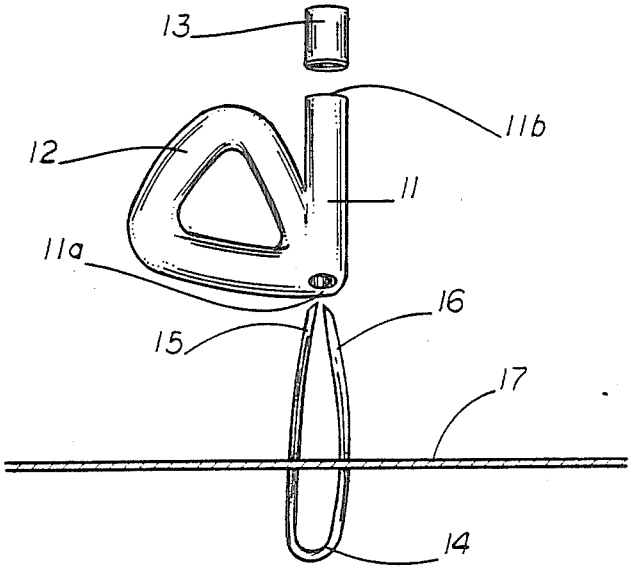
FIG. 5 is a side exploded view showing the invention as applied to drapery fabric.

Referring now to the drawings which illustrate application of this invention to draperies, the ring member 10 comprises an open tubular section 11 having a front open end 11*a* and a rear open end 11*b*. Integral with the tubular section 11 is a closed loop section 12 through which the shade cord passes. A sleeve 13 is provided which registers with open end 11*b* to hold the bent-over legs 15 and 16 of filament 14 in position on the drapery fabric 17.

Figures 6, 7:
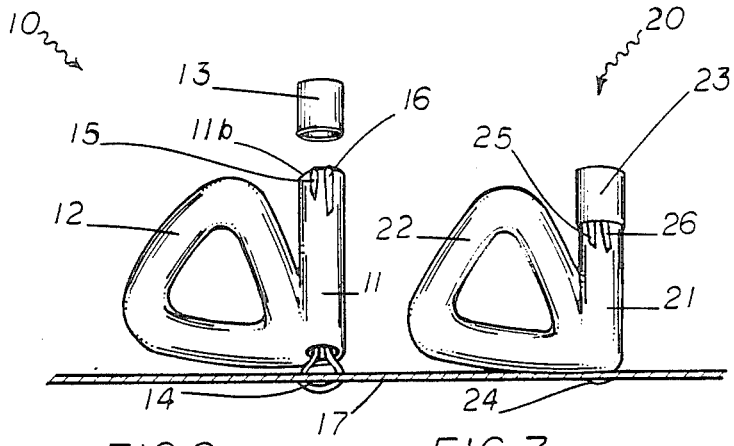
FIG. 6 shows the device in position on the fabric with sleeve unattached.
FIG. 7 shows the device as in FIG. 6 with sleeve attached.

The sequence is to first insert the U-shaped filament 14 through the fabric 17 so that its legs 15 and 16 pass through the open tube 11 coming out at end 11*b* where they are bent-over and then held in position by removable sleeve 13. The complete combination is shown with respect to device 20 in FIG. 7.

Figure 8:
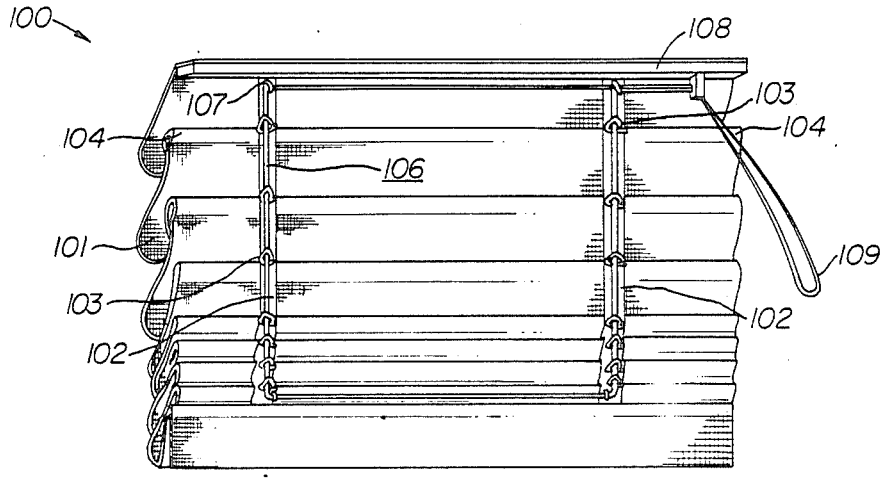
FIG. 8 is a perspective view of a Roman shade utilizing the rings of this invention.
Figure 9:
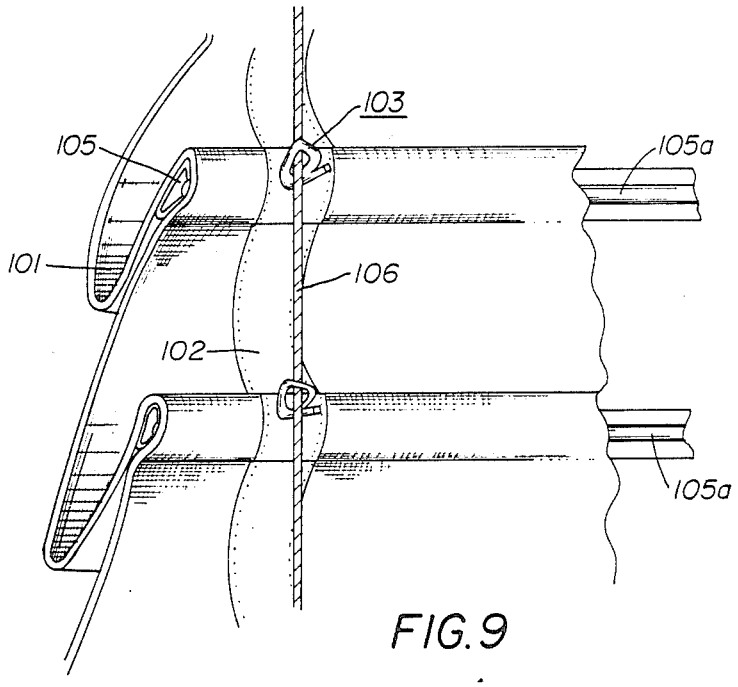
FIG. 9 is an enlarged partial view of FIG. 8.

A common application of the rings of this invention to a Roman shade 100 is illustrated in FIGS. 8 and 9. The rings 103 are attached in predetermined locations through fabric tape 102 and vinyl stiffener 105 having a trough 105*a* and pre-drilled holes for insertion of the filament legs through the stiffener, tape and drapery fabric. A support 108, such as a wooden member which is mounted on the window with brackets, holds the tapes 102. A cord 106 is threaded through the rings 103 then through top screw-eyes 107 to handle 109. The locations of the rings and fabric lengths provide the folds 101 and creases 104 of the drapery fabric. In a conventional manner, stiffeners 105 having troughs 105*a* extend through folds 104. Tapes 102 are attached to successive folds.

I claim:

1. A device which when attached to a sheet provides a closed loop depending from the sheet, comprising: the combination of a U-shaped filament, a tubular member and filament holding means; said tubular member having a closed loop portion attached thereto; the legs of said filament being adapted to pass through the sheet and into said tubular member; said holding means being adapted to hold the filament legs in position on said tubular member.

2. The device of claim 1 wherein said holding means is removable, thus permitting said filament to be withdrawn and reattached to another location on the sheet.

* * * * *